US009909346B2

(12) United States Patent
Holzapfel

(10) Patent No.: US 9,909,346 B2
(45) Date of Patent: Mar. 6, 2018

(54) ADJUSTING DEVICE

(71) Applicant: Julius Blum GmbH, Hoechst (AT)

(72) Inventor: Andreas Holzapfel, Bregenz (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 15/053,343

(22) Filed: Feb. 25, 2016

(65) Prior Publication Data

US 2016/0168896 A1 Jun. 16, 2016

(30) Foreign Application Priority Data

Aug. 30, 2013 (AT) ..... 675/2013

(51) Int. Cl.
*E05D 15/00* (2006.01)
*E05D 15/40* (2006.01)
*E05F 1/10* (2006.01)

(52) U.S. Cl.
CPC ..... *E05D 15/401* (2013.01); *E05F 1/1058* (2013.01); *E05Y 2201/638* (2013.01); *E05Y 2600/56* (2013.01); *E05Y 2800/372* (2013.01); *E05Y 2900/20* (2013.01)

(58) Field of Classification Search
CPC ..... E05D 15/401; E05D 15/406; E05F 1/10; E05F 1/1058; E05F 2600/56; E05F 2800/372; E05F 2900/20
See application file for complete search history.

(56) References Cited

U.S. PATENT DOCUMENTS

| | | | | |
|---|---|---|---|---|
| 6,877,830 | B2 | 4/2005 | Salice | |
| 9,464,473 | B2 | 10/2016 | Baldreich | |
| 2002/0108311 | A1 | 8/2002 | Salice | |
| 2007/0209157 | A1* | 9/2007 | Kung | E05D 15/262 16/240 |
| 2007/0257538 | A1* | 11/2007 | Brunnmayr | E05D 15/262 297/423.12 |
| 2011/0138960 | A1* | 6/2011 | Omann | E05C 19/165 74/490.07 |
| 2012/0000130 | A1* | 1/2012 | Kashiwaguma | E05F 1/1058 49/348 |

(Continued)

FOREIGN PATENT DOCUMENTS

| | | |
|---|---|---|
| AT | 513387 | 4/2014 |
| CN | 103109029 | 5/2013 |

(Continued)

OTHER PUBLICATIONS

Austrian Search Report dated May 14, 2014 in corresponding Austrian Patent Application No. 675/2013 (with English translation).

(Continued)

*Primary Examiner* — Daniel J Rohrhoff
(74) *Attorney, Agent, or Firm* — Wenderoth, Lind & Ponack, L.L.P.

(57) ABSTRACT

The invention relates to an adjusting device for moveably mounting a furniture part onto a furniture body, comprising an adjusting arm lever. A first lever of the adjusting arm lever can be moved with respect to a second lever of the adjusting arm lever from a mounted position into an operating position. The first lever can be locked in the locked position with respect to the second lever by means of an automatic locking device.

19 Claims, 23 Drawing Sheets

(56) References Cited

U.S. PATENT DOCUMENTS

Figure 1A:
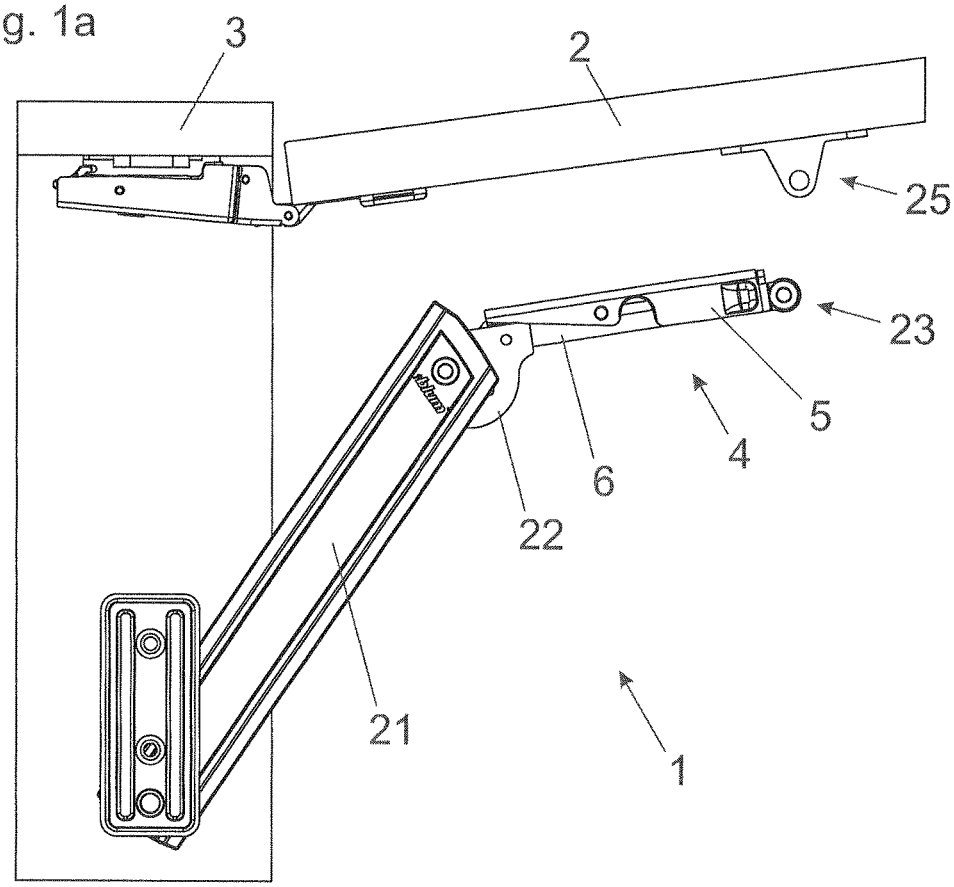

| | | | | |
|---|---|---|---|---|
| 2012/0102676 | A1* | 5/2012 | Fang | E05F 1/1058 16/277 |
| 2012/0161598 | A1* | 6/2012 | Blum | E05F 1/1276 312/319.2 |
| 2013/0333291 | A1* | 12/2013 | Blum | E05F 1/1058 49/386 |
| 2014/0317883 | A1 | 10/2014 | Baldreich | |
| 2015/0351539 | A1 | 12/2015 | Baldreich et al. | |
| 2016/0160551 | A1* | 6/2016 | Lutz | E05D 11/1064 74/469 |

FOREIGN PATENT DOCUMENTS

| | | |
|---|---|---|
| EP | 1 223 282 | 7/2002 |
| EP | 1 812 674 | 8/2007 |
| EP | 2 450 513 | 5/2012 |
| JP | 2002-227513 | 8/2002 |
| JP | 2009-121194 | 6/2009 |
| WO | 2006/039729 | 4/2006 |
| WO | 2006/130888 | 12/2006 |
| WO | 2013/113047 | 8/2013 |

OTHER PUBLICATIONS

International Search Report dated Nov. 4, 2014 in corresponding International Application No. PCT/AT2014/000154 (with English translation).

Chinese Search Report dated Nov. 22, 2016 in Chinese Application No. 201480056275.5.

* cited by examiner

ADJUSTING DEVICE

The present invention concerns an actuating device having the features of the classifying portion of claim 1, an article of furniture having such an actuating device and a method of mounting a moveable furniture part to a furniture carcass by means of such an actuating device.

In particular the present invention concerns furniture flaps which are mounted to a furniture carcass pivotably about a horizontal axis.

An actuating device of the general kind set forth is disclosed in the Austrian patent application bearing the application filing number A 103/2013, which is not a prior publication. It includes a housing mounted pivotably to the furniture carcass, and an actuating arm lever mounted pivotably to the housing. The housing accommodates a force storage means—in this embodiment a coil spring—, whereby a control cam arranged on the actuating arm lever is acted upon with a force. That control cam has an apex point whereby, depending on the respective position of the actuating arm lever relative to the housing, the force acts on extending or opening the actuating device or bending or closing the actuating device.

When mounting actuating devices of that general kind the problem which arises is that fixing the actuating arm lever to the moveable furniture part is not easily possible either in the bent or in the extended position of the actuating arm lever.

In the completely bent position that is apparent as that would require fitment from the interior of the furniture carcass.

The actuating device is of such dimensions that, even when the flap is fully opened, the actuating device is not completely extended. That is intended to ensure that the return force for the opened position is sufficiently high in all situations. That has the result however that the actuating arm lever has to be bent somewhat by the fitter in the fitting operation (see FIGS. 7*a*, 7*b*, 8*c* and 8*b*). That requires a high degree of effort on the one hand and on the other hand is difficult for an individual person as the flap has to be held and the actuating arm lever has to be fixed to the flap, at the same time.

Actuating devices for furniture flaps which have an actuating arm lever with longitudinal displacement are known for example from WO 2006/039729 A1. In that case, after fixing of the actuating arm lever to the flap, the flap has to be closed whereby the length of the actuating arm lever is adjusted. After that however the flap has to be opened again in order to lock the actuating arm lever in the set length. That working step is in itself not necessary. In addition the length adjustment of the actuating arm lever must be made quite stiff in order not to allow unintentional adjustment during the opening movement.

In the case of actuating devices which have both a pivotable housing and also a pivotable actuating arm lever that last-mentioned effect is intensified for, as upon opening of the flap, the force storage means would work directly towards a change in length of the actuating arm lever.

The object of the invention is to provide an actuating device and an article of furniture having such an actuating device, which are distinguished by simplified mounting. In addition the invention seeks to provide a method of mounting such an actuating device.

That object is attained by an actuating device having the features of claim 1, an article of furniture having such an actuating device and a method having the features of claim 18.

That is achieved by a first lever of the actuating arm lever being lockable relative to a second lever of the actuating arm lever by means of an automatic locking device in the operating position. This means that locking in the operating position is effected automatically without further action on the part of the fitter or the user, generally within the furniture carcass. That automatic action when moving the levers of the actuating arm lever relative to each other can be implemented in various ways. Examples would be snap-in engagement or latching engagement. However a locally implemented frictional engagement is also possible, that is to say for example by a narrowing of the outer lever or a local roughening of sliding surfaces. The mounting position is distinguished in that it allows simplified mounting of the actuating arm lever to the furniture part, than the operating position which is suitable for operation.

Further advantageous embodiments of the invention are defined in the appendant claims.

For example by virtue of the fact that a length of the actuating arm lever can be set by the mobility of the first lever relative to the second lever the actuating arm lever can be adjusted from a generally short mounting length to a predefined operative length for operation.

To ensure that no unwanted change in the actuating arm lever from the mounting position occurs prior to mounting there can be provided an arresting device for releasably arresting the first lever relative to the second lever in the mounting position of the actuating arm lever.

It can preferably be provided that the locking device is of a positively locking nature. Secure locking in the operating position can be achieved thereby.

Preferably there can further be provided a force storage means for acting on the actuating arm lever with a movement force for movement of the furniture part. That makes it possible to provide that the user is assisted when opening and/or closing the furniture part, and profits from a defined closed and/or opened position of the furniture part.

It can particularly preferably be provided that the arresting of the first lever relative to the second lever is releasable by the action of the movement force. It can further preferably be provided that the first lever is moveable relative to the second lever by the action of the movement force into the operating position. Both can serve to relieve the burden on the fitter as he does not have to apply the force for releasing the arresting means or for producing the movement of the actuating arm lever into the operating position.

In a particularly preferred embodiment it can be provided that the arresting device and/or the locking device includes a spring element, wherein there is preferably provided precisely one spring element. In particular with the structure having precisely one spring element it can be provided that the arresting device functions in force-locking relationship and the locking device in positively locking relationship.

For ease of manufacture of the spring element it can be provided that the spring element is in the form of a shaped portion with at least one protrusion determining the transverse extent and a spring zone for producing the spring force.

It can further be provided that the spring element includes at least one projection which by cooperation with an opening on the first lever or on the second lever limits relative movements of the spring element relative to the first lever or to the second lever. That makes it possible to prevent the spring element from leaving an intended position relative to one of the levers during the movement.

A force-locking arresting action on the part of the arresting device can be particularly easily achieved in that the arresting device includes at least one recess cooperating with the spring element, wherein the at least one recess preferably cooperates with the at least one protrusion and there are preferably provided precisely two recesses.

A positively locking relationship on the part of the locking device can be easily achieved if the locking device includes at least one opening cooperating with the spring element, wherein the at least one opening preferably cooperates with the at least one protrusion and there are preferably provided precisely two openings. In this structure therefore the at least one protrusion of the spring element is used as a locking bolt cooperating with an opening.

Figure 8A:
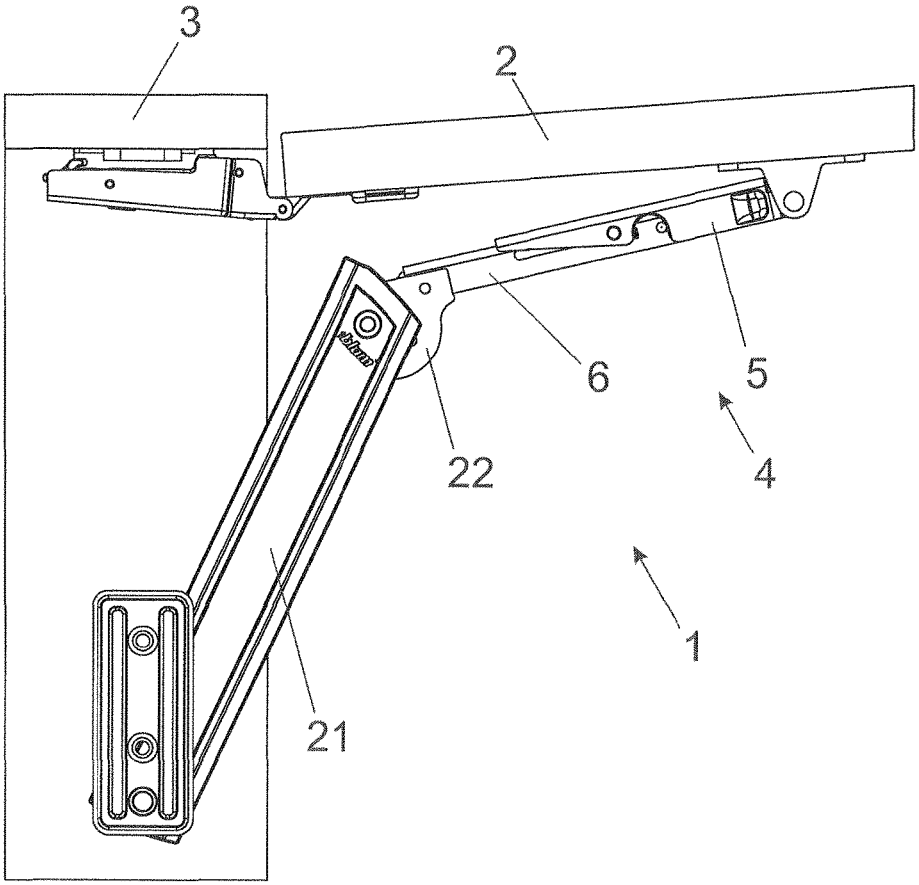
Figure 8B:
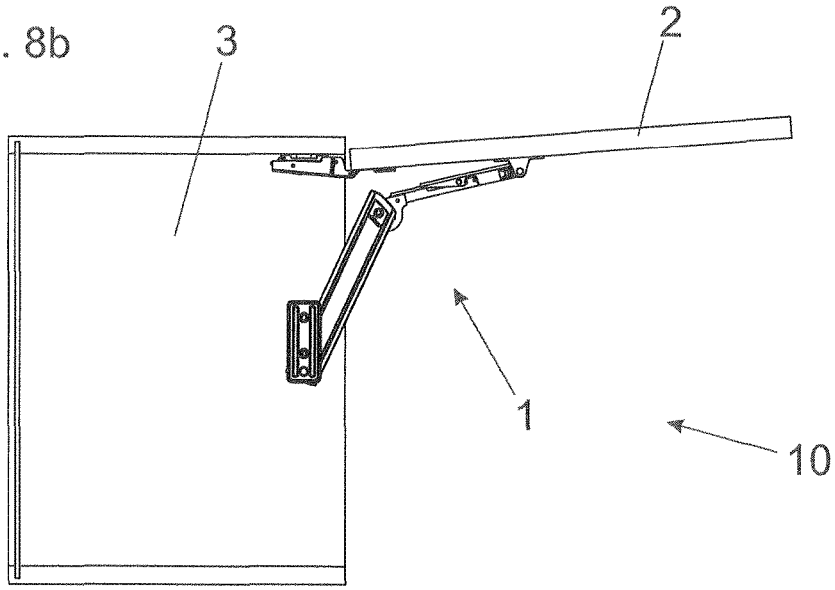
Figure 9A:
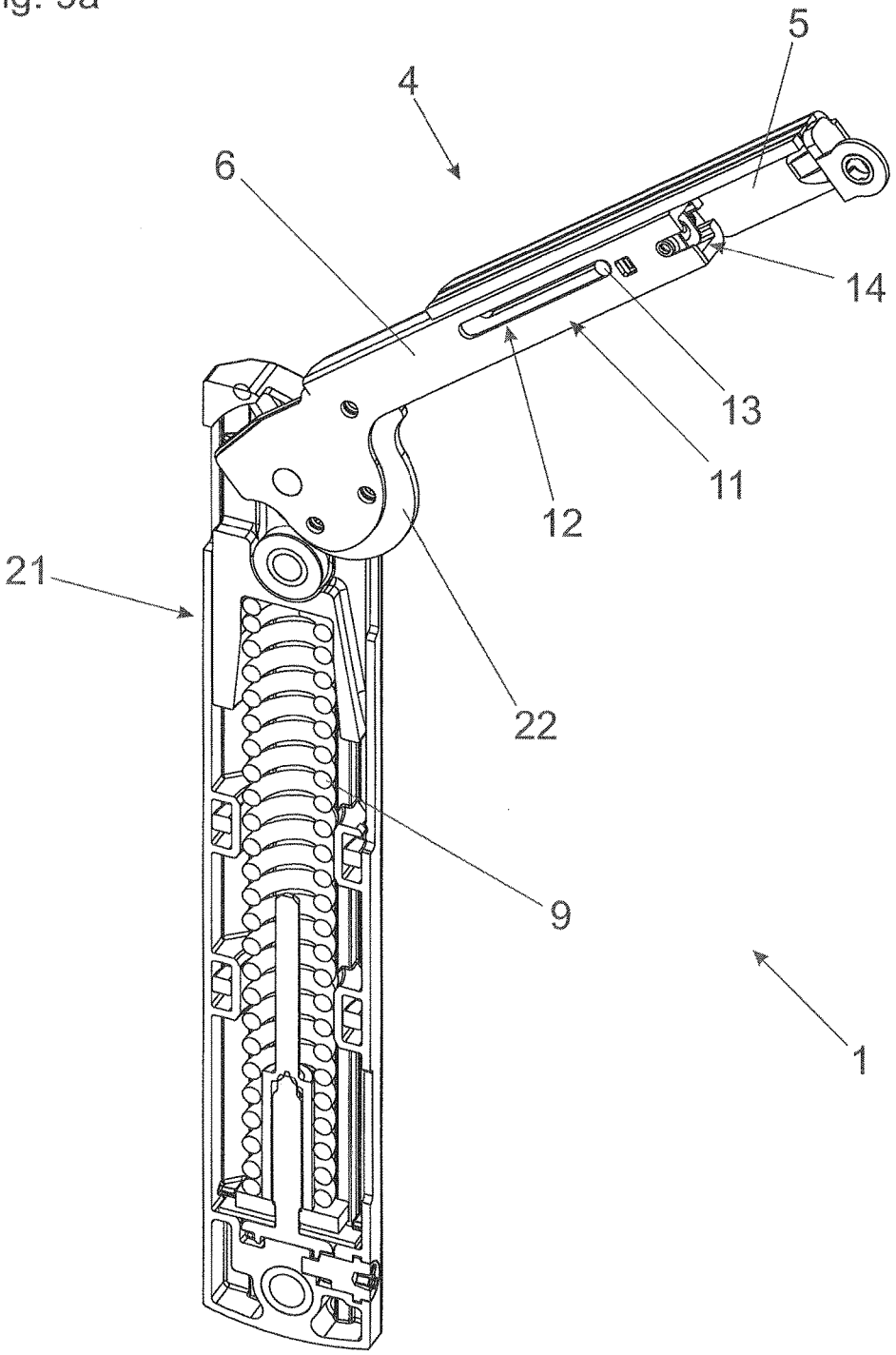
Figure 9B:
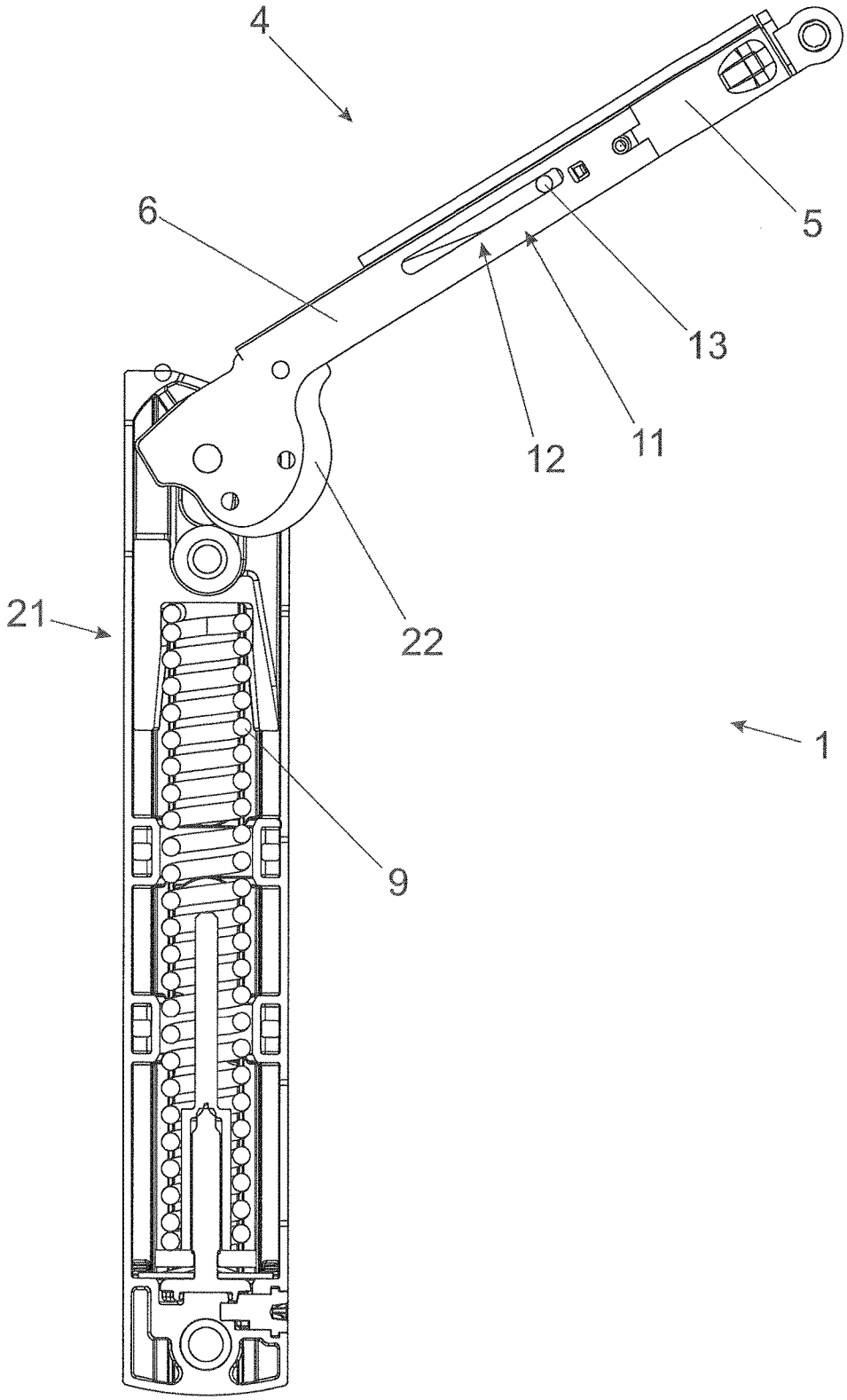
Figure 9C:
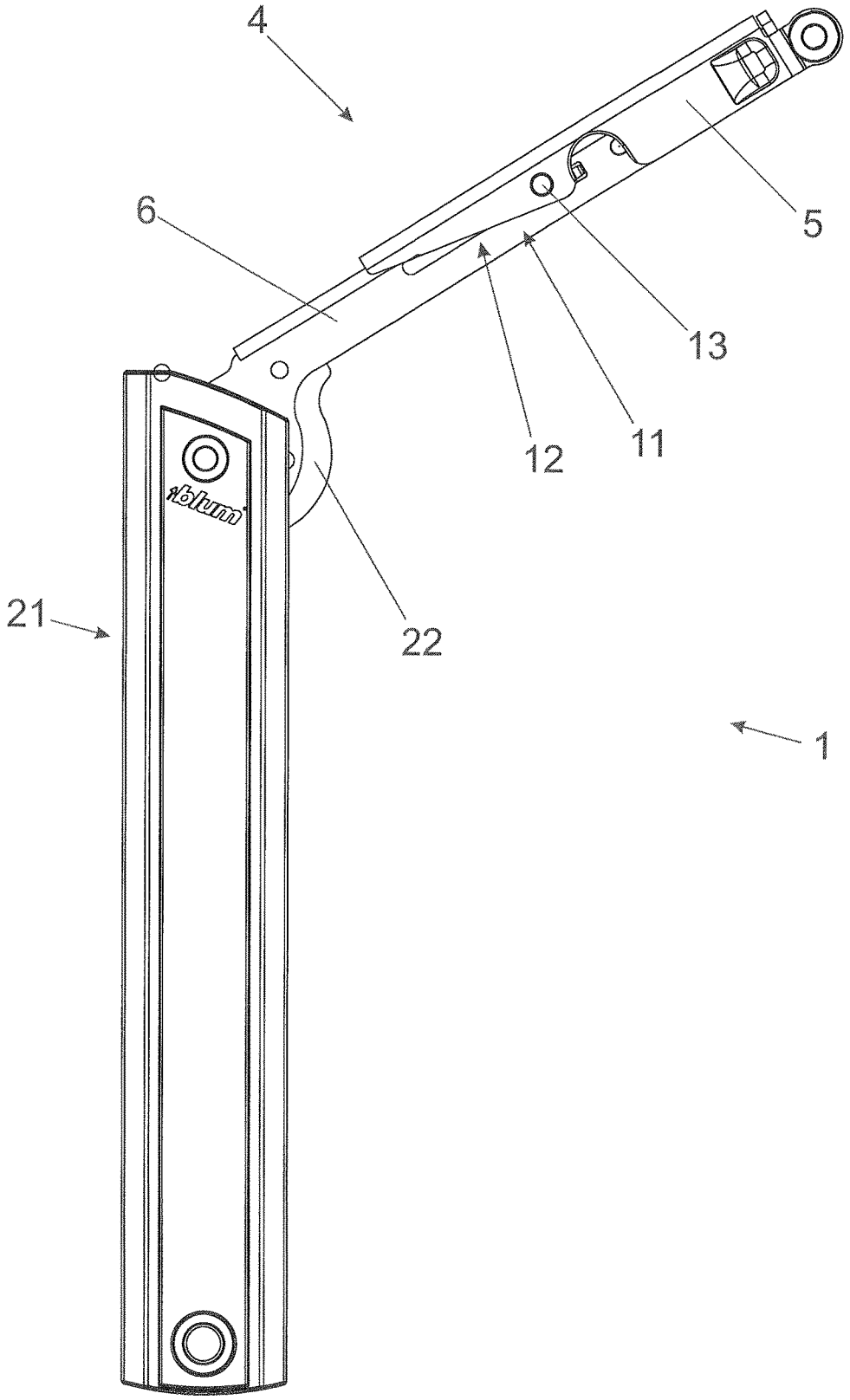
Figure 10A:
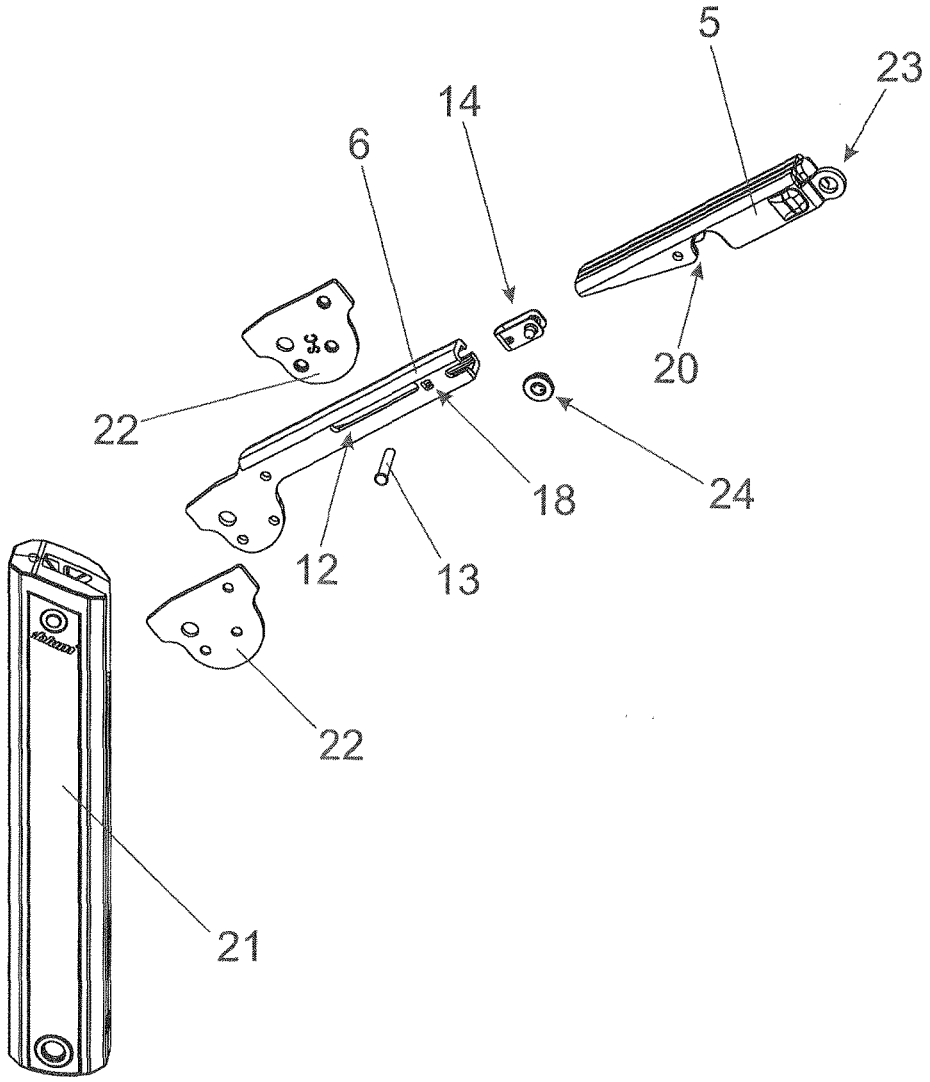
Figure 10B:
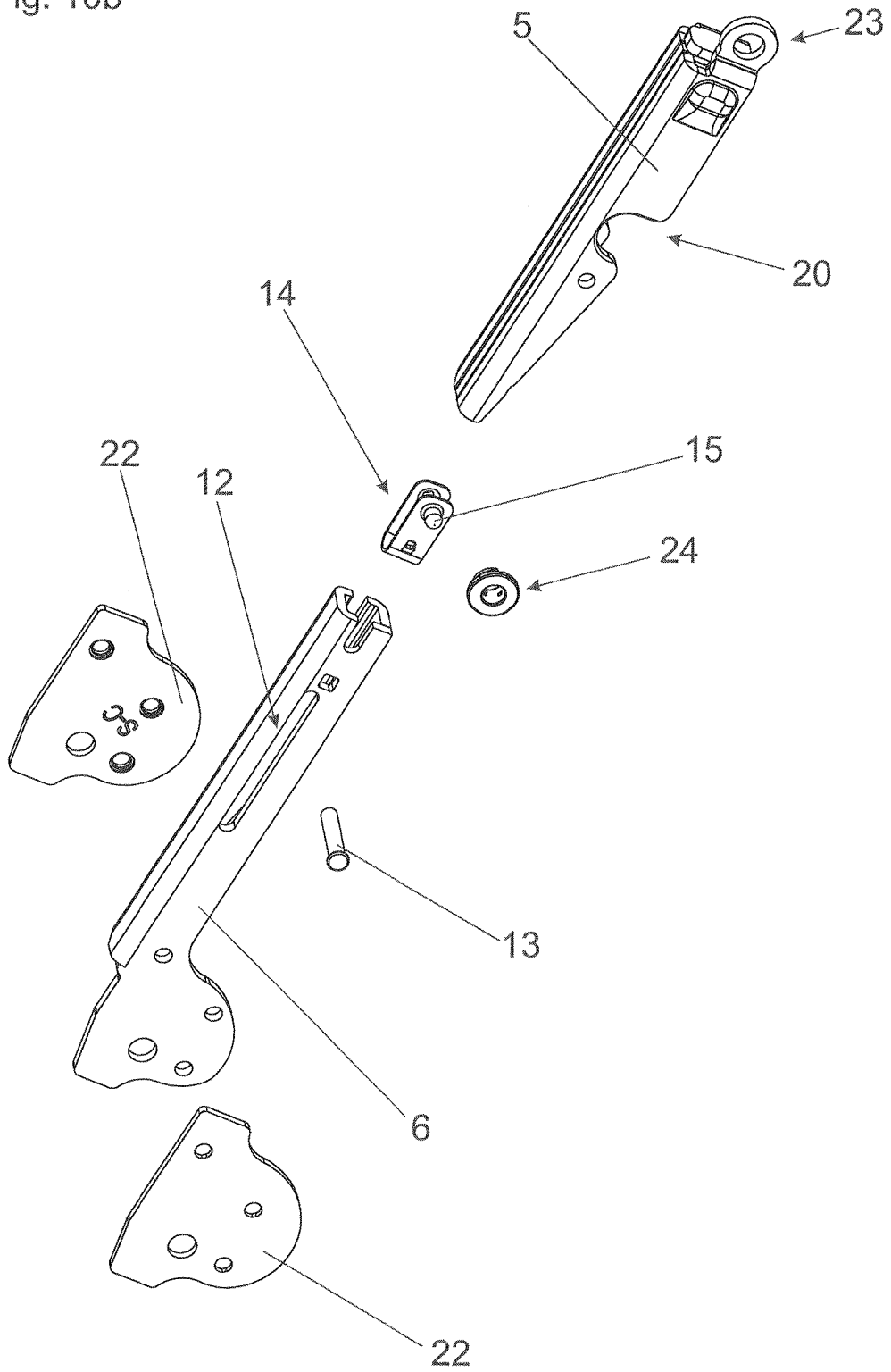
Figure 14A:
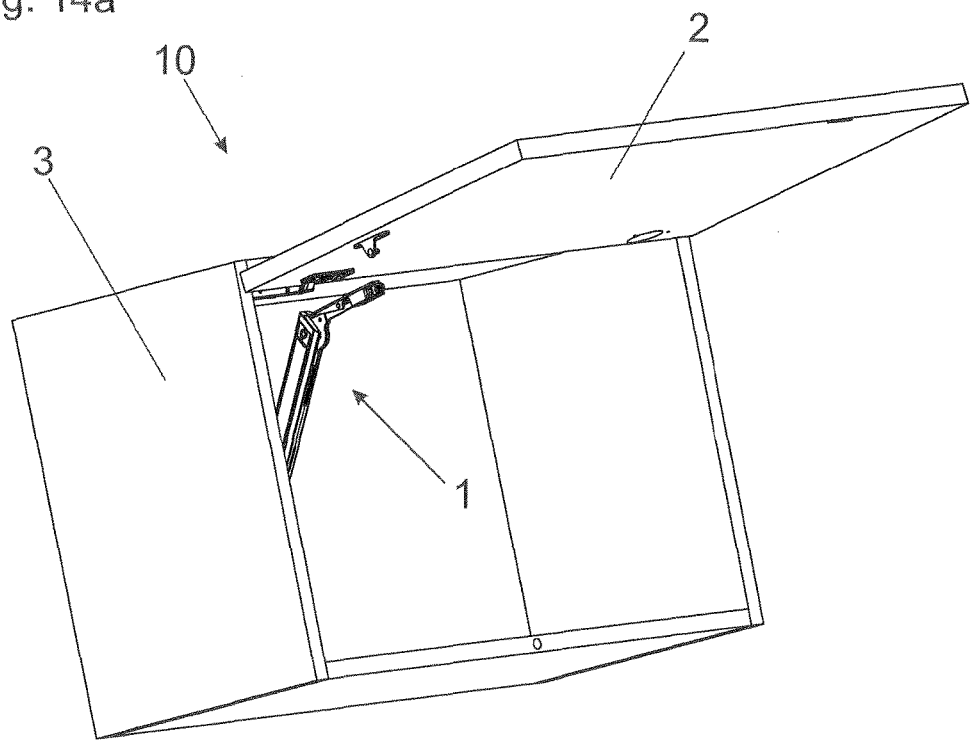
Figure 14B:
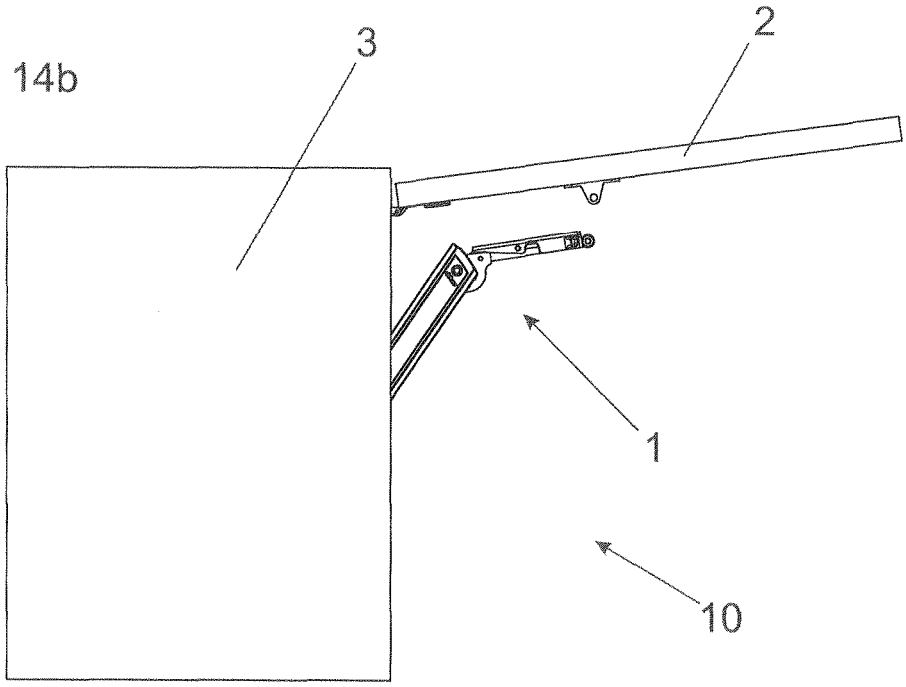

Further advantages and details of the invention will be apparent from the Figures and the related specific description. In the drawing:

FIGS. 1*a* and 1*b* through 6*a* and 6*b* show a plurality of steps during mounting of an actuating device according to the invention, FIGS. 7*a*, 7*b*, 8*a* and 8*b* show a mounting method similar to the state of the art, FIGS. 9*a* through 9*c* show three different views of an actuating device according to the invention, FIGS. 10*a* and 10*b* show exploded views of the actuating device according to the invention or the actuating arm lever, FIGS. 11*a* through 11*f* show various views and sectional views of the actuating arm lever in the mounting position, FIGS. 12*a* through 12*f* show various views and sectional views of the actuating arm lever according to the invention in an intermediate position, FIGS. 13*a* through 13*f* show various views and sectional views of the actuating arm lever in the operating position, and FIGS. 14*a* and 14*b* show two views of an article of furniture with an actuating device according to the invention during the beginning of the mounting method.

Figure 1B:
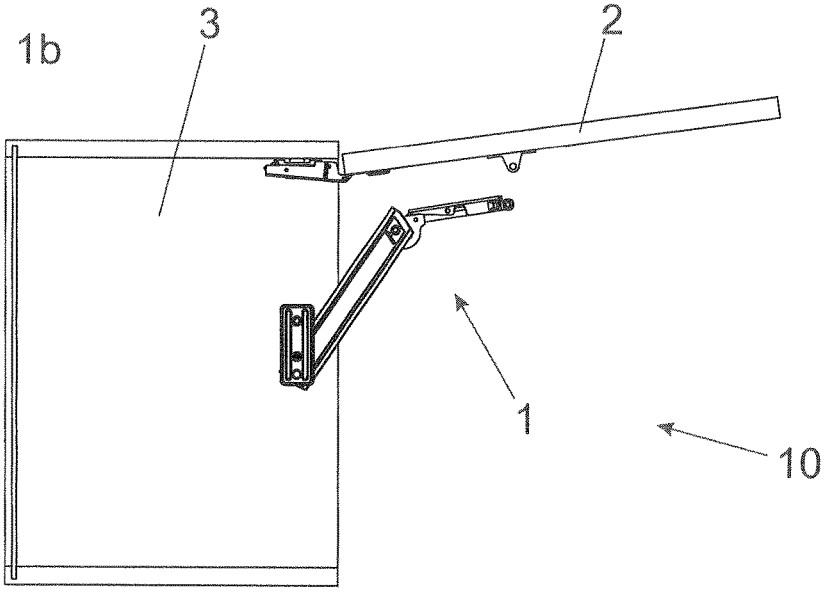

FIGS. 1*a* and 1*b* show a sectional view and an enlarged sectional view of an article of furniture 10 having an actuating device 1 according to the invention. The housing 21 is mounted pivotably to the carcass 3 of the article of furniture 10. It accommodates a force storage means 9 (see FIGS. 9*a* and 9*b*) by which the control cam 22 is acted upon with a force. The actuating arm lever 4 is fixedly connected to the control cam 22. It has a first lever 5 and a second lever 6. They are disposed relative to each other in the mounting position, in this case of the shortest length of the actuating arm lever. By virtue of the control cam 22 being acted upon by the force storage means 9 the actuating device 1 automatically straightens from the angular positions shown in FIGS. 1*a* and 1*b* in order then to be connected to the furniture part 2, in this case a flap.

Figure 2A:
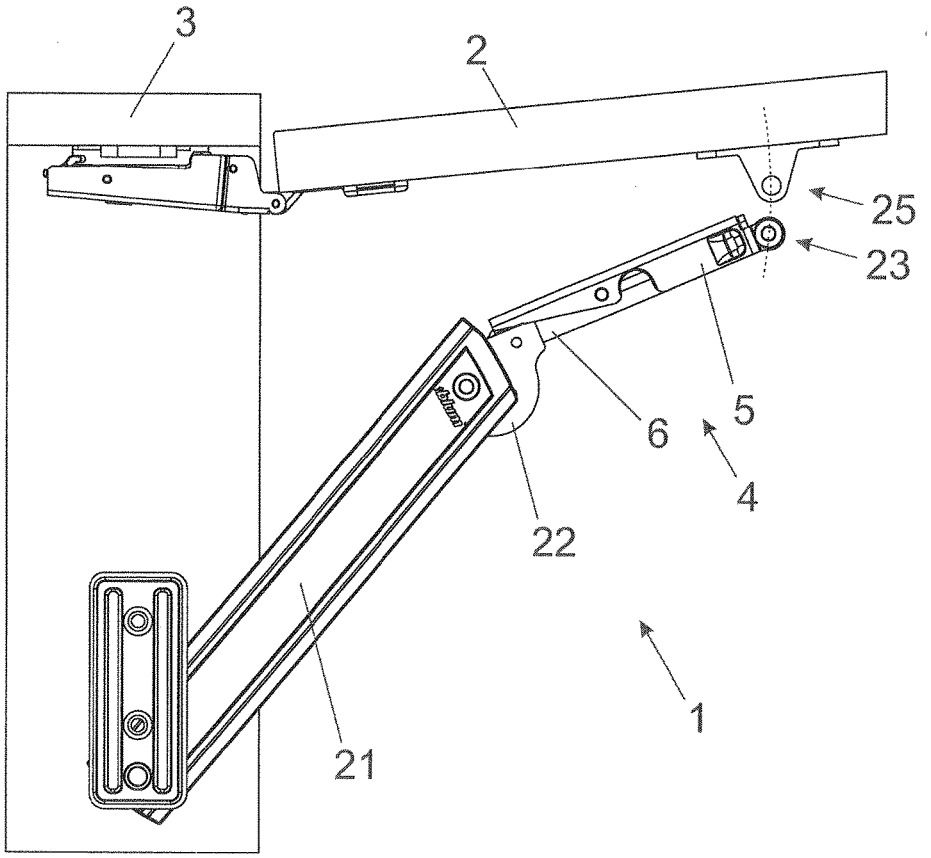
Figure 2B:
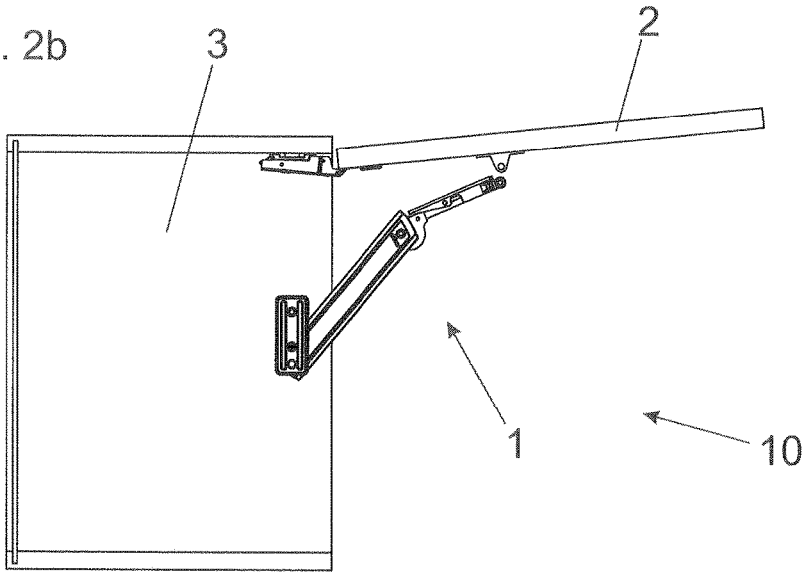

The completely extended angular position of the actuating arm lever 1 is shown in FIGS. 2*a* and 2*b*. It is to be noted that the fitter only has to hold the angular position of the flap 2 and of the housing 21 in order to bring the eye 23 for fixing to the furniture flap 2 in congruent relationship with the fixing fitment 25.

Figure 3A:
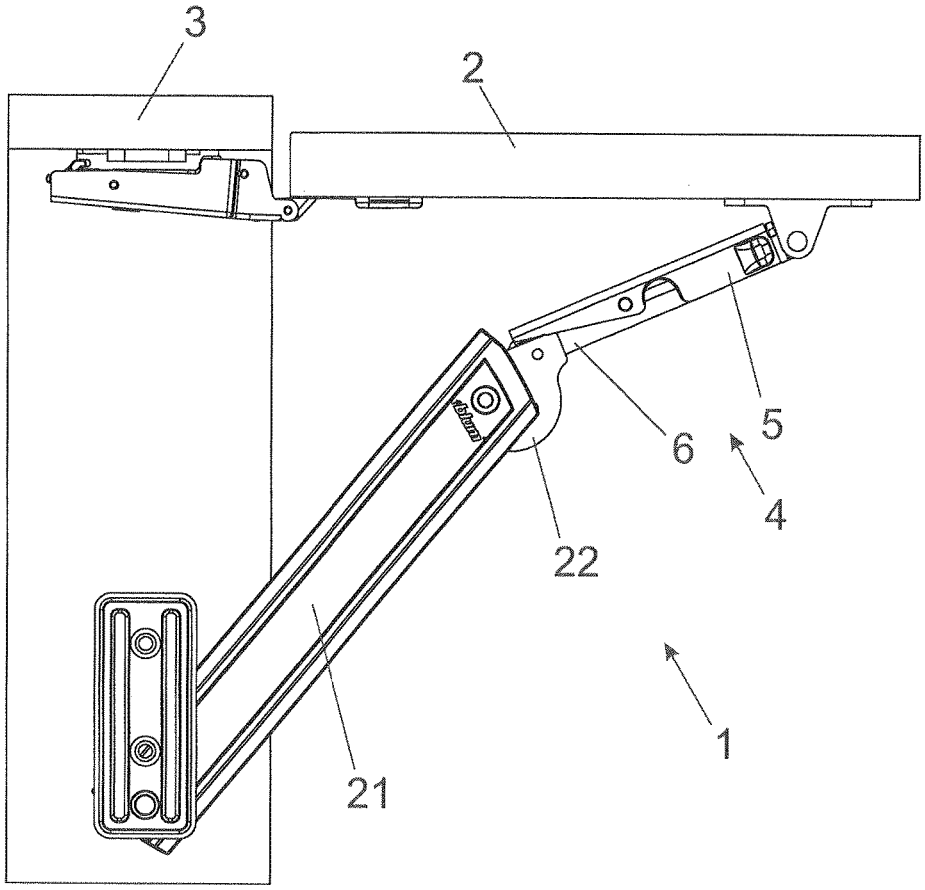
Figure 3B:
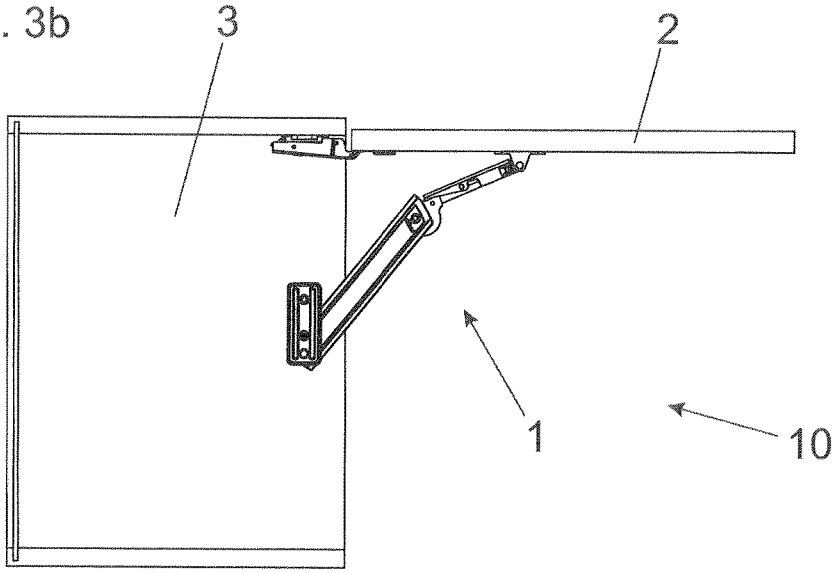
Figure 4A:
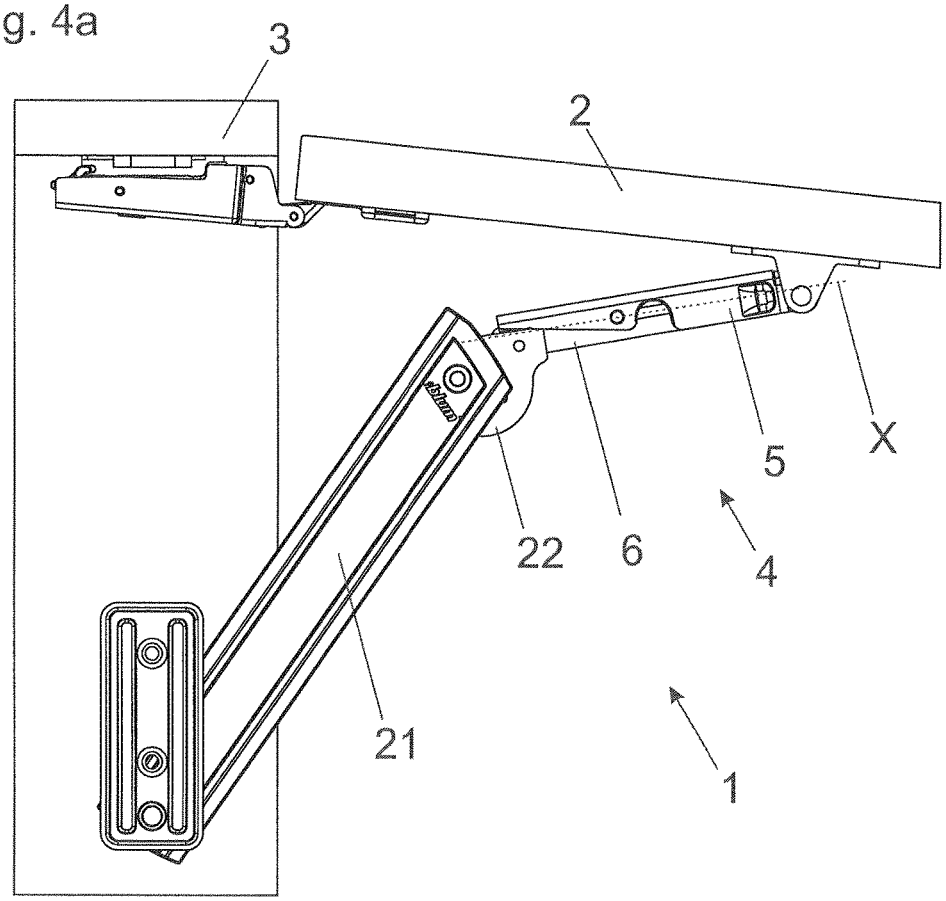
Figure 4B:
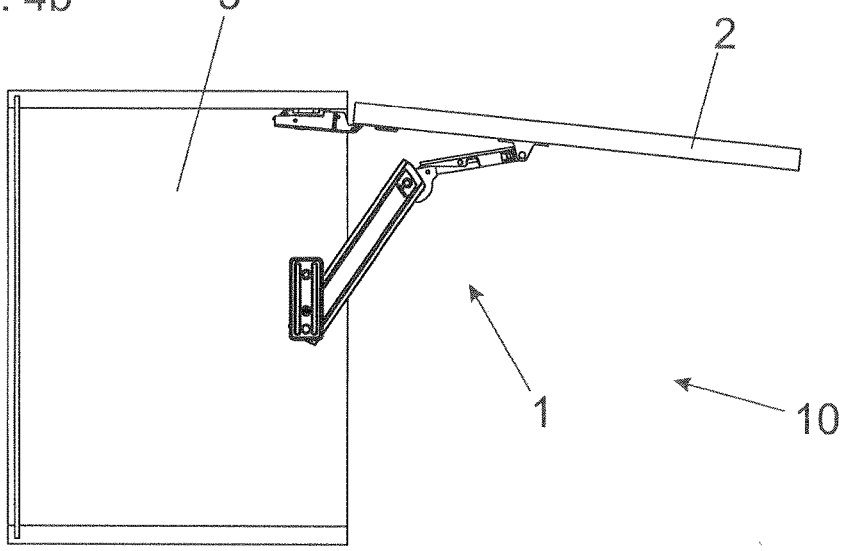
Figure 5A:
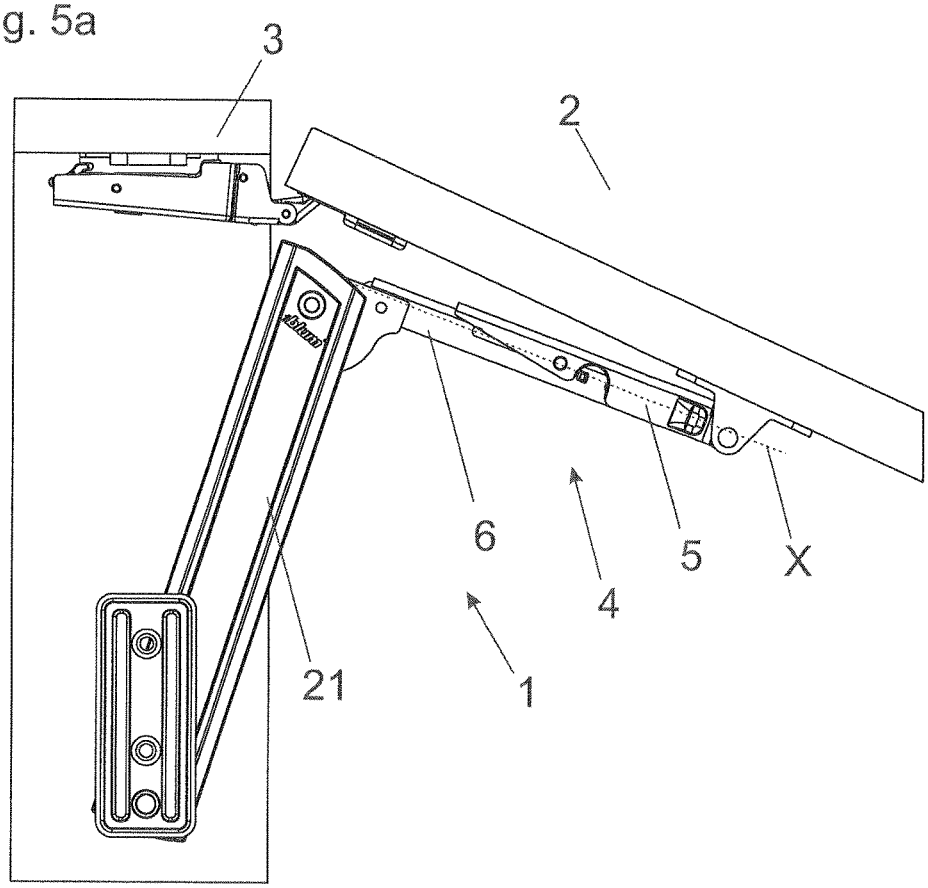
Figure 5B:
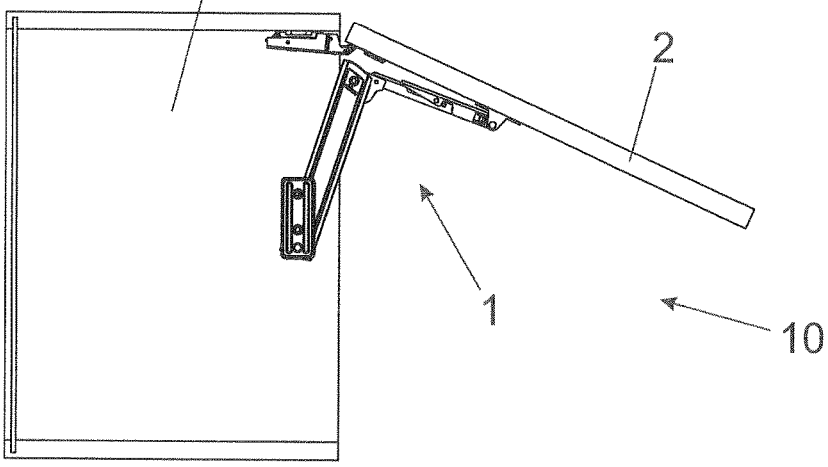
Figure 6A:
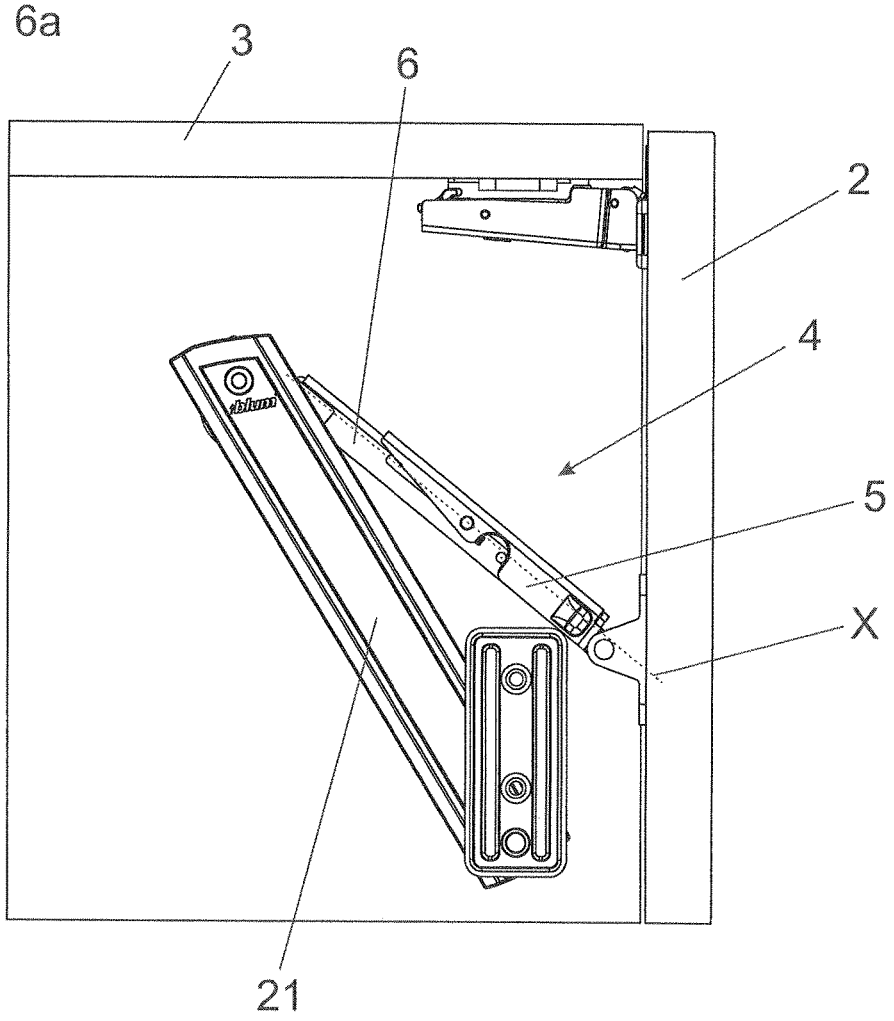
Figure 6B:
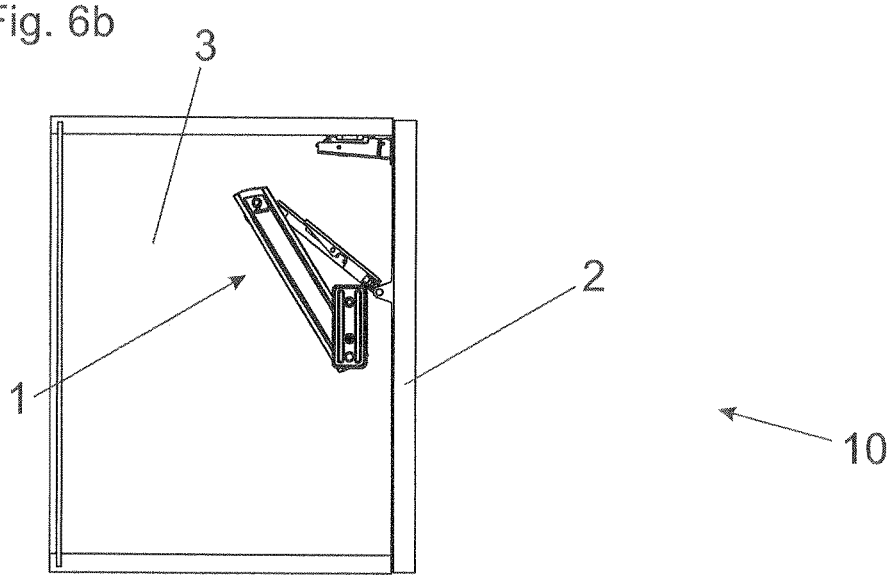
Figure 7A:
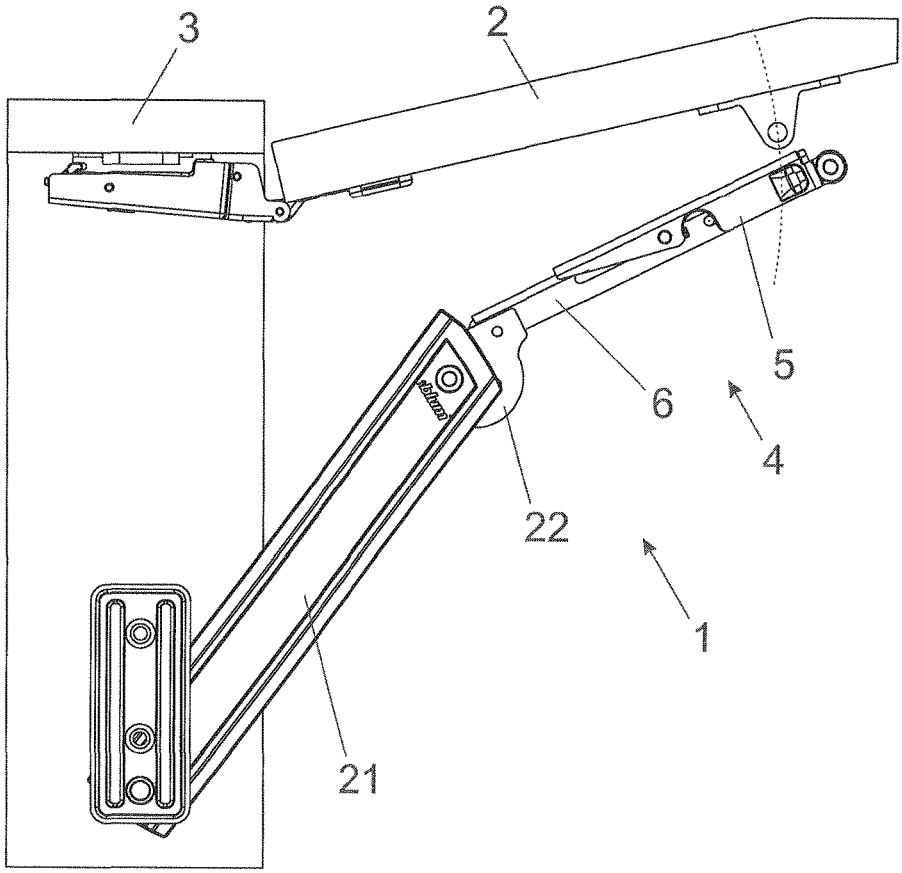
Figure 7B:
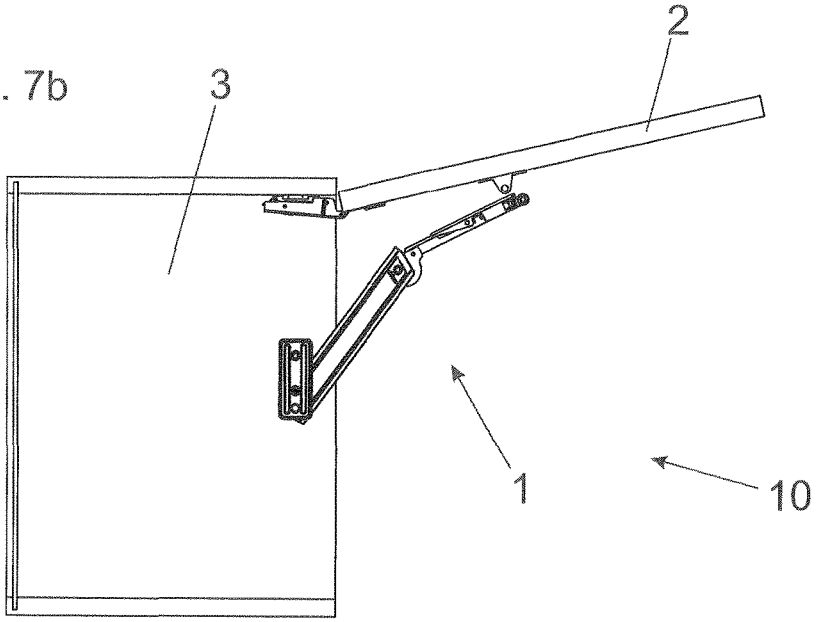

That fixing is implemented by way of a fixing clip 24 (see in that respect FIGS. 10*a* and 10*b*). The fixed position is shown in FIGS. 3*a* and 3*b*.

The fitter can now begin to close the flap (FIGS. 4*a*, 4*b* and 5*a*, 5*b*) whereby a force is exerted along the relative axis of movement X of the first lever 5 and the second lever 6 by the force storage means 9 in cooperation with the control cam 22. The result is a prolongation of the actuating arm lever 4 (see FIGS. 11*a* through 11*f*, 12*a* through 12*f* and 13*a* through 13*f*). At the latest in that position the actuating arm lever 4 has reached the operating position and is locked in that position.

To illustrate one of the problems of the present invention FIGS. 7*a*, 7*b*, 8*a* and 8*b* show how a mounting operation would have to take place if the actuating arm lever 4 were already in the operating position at the beginning, as is the case in the state of the art. As can be seen from the circular arc indicated in FIG. 7*a* fixing of the actuating arm lever 4 to the furniture part 2 cannot take place in the completely extended position of the actuating device 1 (see in that respect also the circular arc in FIG. 2*a*). As shown in FIGS. 8*a* and 8*b* the fitter has to hold the angular position of the furniture part 2, the angular position of the housing 21 and the angular position of the actuating arm lever 4 relative to the housing 21—against the action of the force storage means 9—in the precisely correct fashion in order to permit fixing.

FIGS. 9*a* through 9*c* show two sectional views through an actuating arm lever 1 according to the invention and a side view. That makes the force storage means 9 visible, which acts on the control cam 22 which has an apex point so that the force storage means 9 works towards either complete bending of the actuating device 1 or complete extension of the actuating device 1. The actuating arm lever 4 has a first lever 5 and a second lever 6. For changing the length of the actuating arm lever 4 the first lever 5 and the second lever 6 can be displaced rail-like along each other. A guide means 11 is also provided for relative movements of the first lever 5 and the second lever 6. In this case that is in the form of a slot 12 cooperating with a guide pin 13. It is advantageous in that respect that the two levers 5, 6 are not releasable from each other. In other words, only the mounting position, the operating position and the positions therebetween are possible. An increase in the length of the actuating arm lever 4 by the force storage means 9 beyond the operating position is prevented by a guide means 11 of such a configuration. FIGS. 10*a* and 10*b* are exploded views of an actuating device 1 according to the invention or an actuating arm lever 4. On the one hand that clearly shows the pivotal mounting of the second lever 6 to the housing 21 using two components for the control cams 22. It is also possible to see the spring element 14 which is arranged in the mounting position within the actuating arm lever 4.

In addition it is possible to see the fixing clip 24 serving to fix the eye 23 to a fixing fitment 25.

Figure 11A:
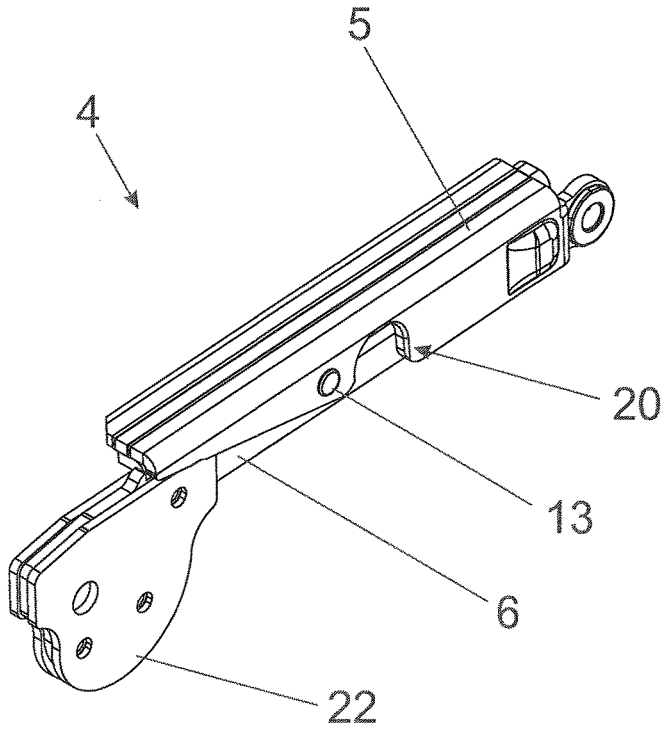
Figure 11B:
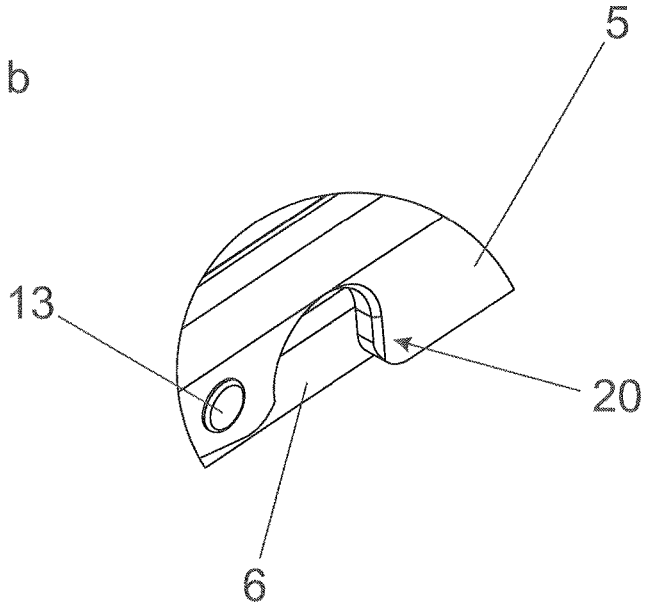
Figure 11C:
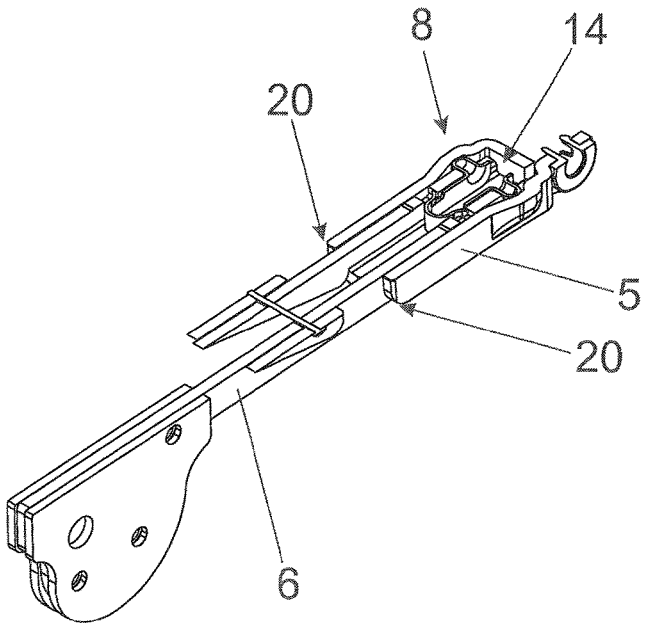
Figure 11D:
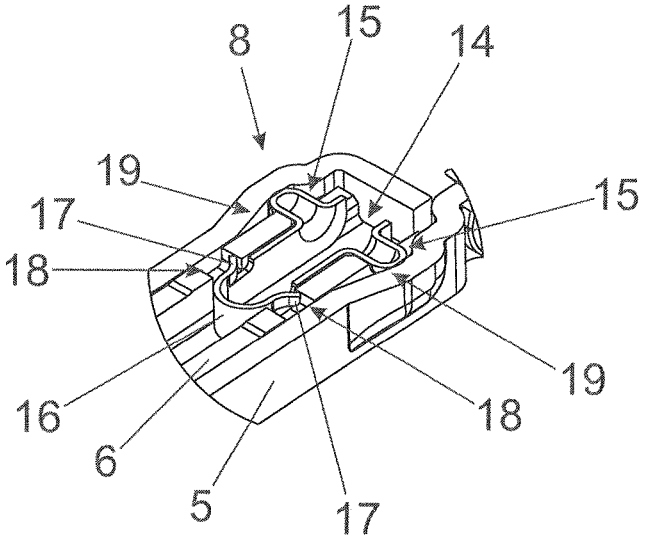
Figure 11E:
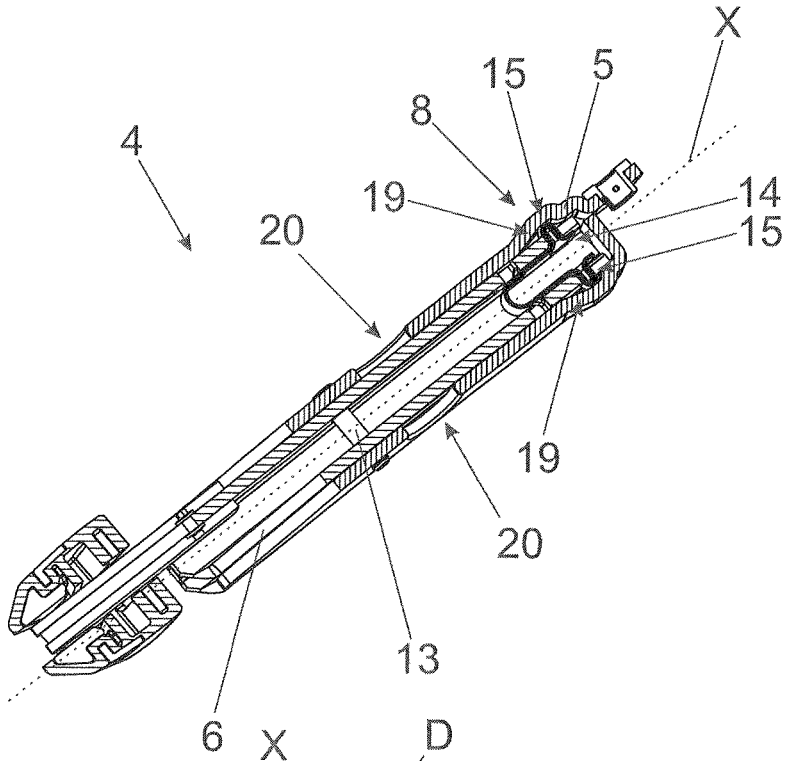
Figure 11F:
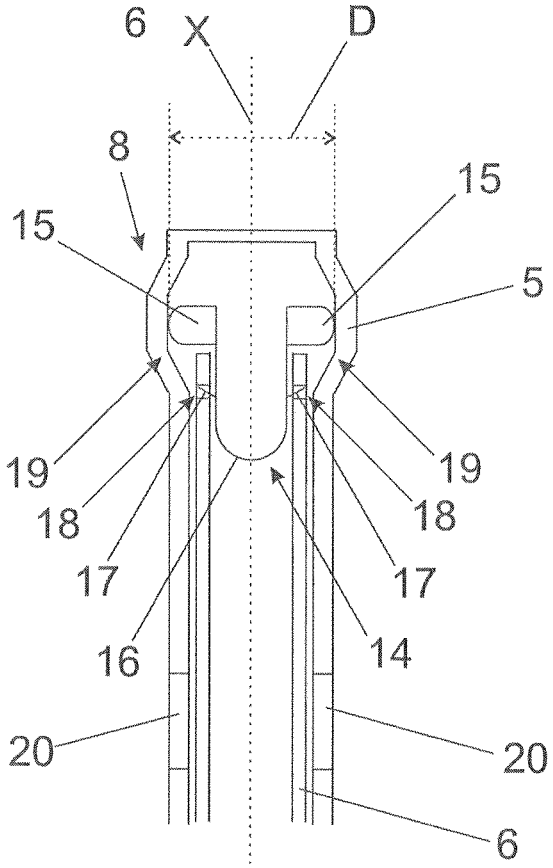
Figure 12A:
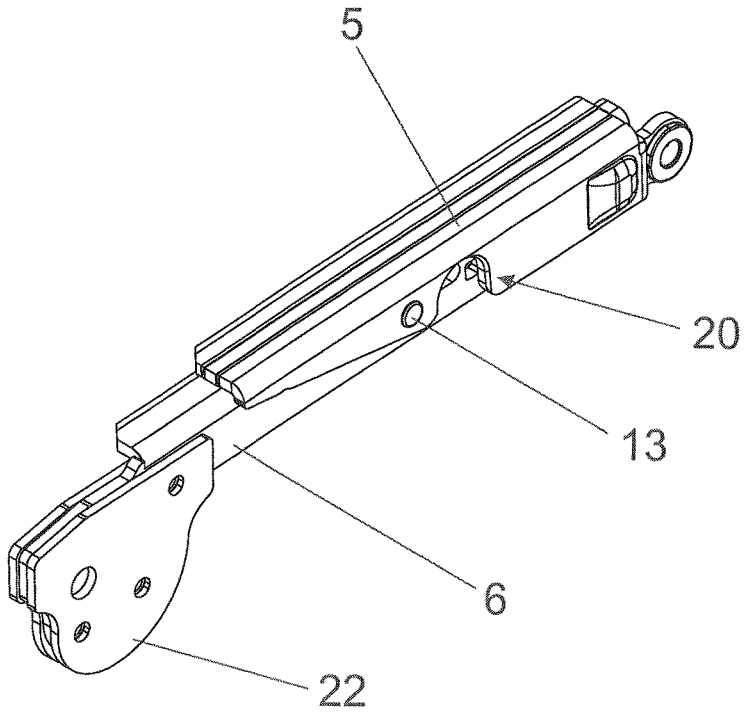
Figure 12B:
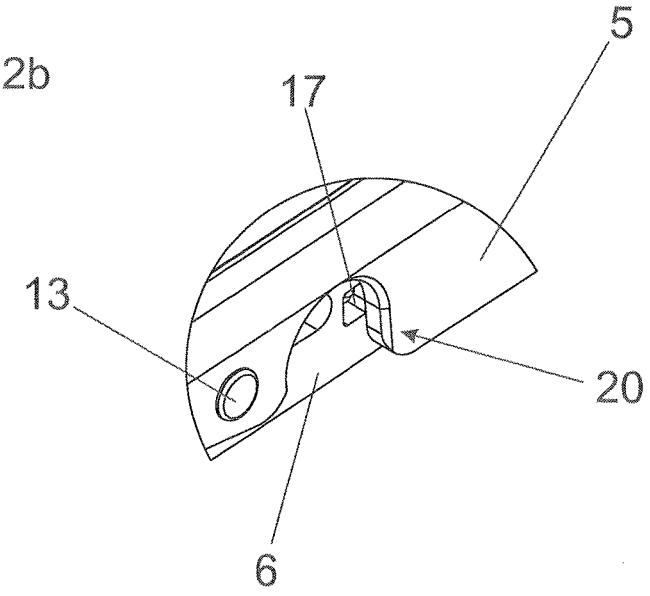
Figure 12C:
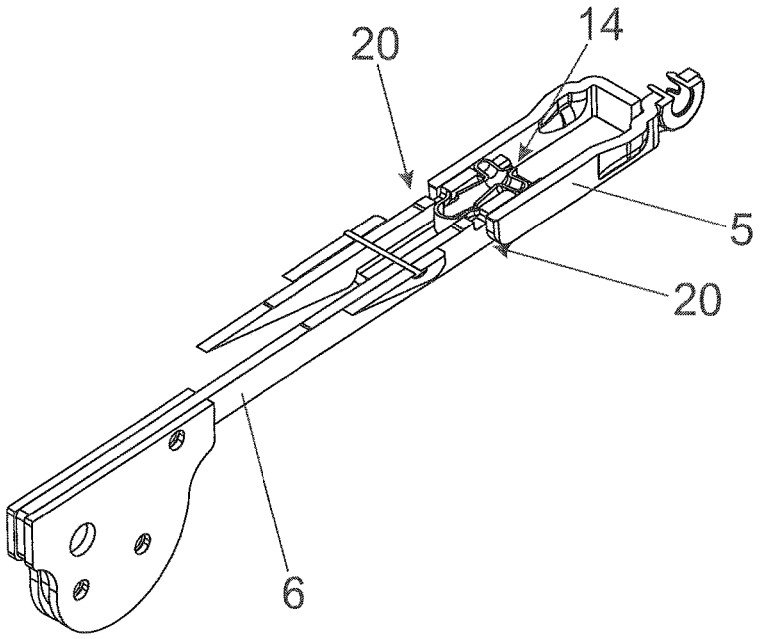
Figure 12D:
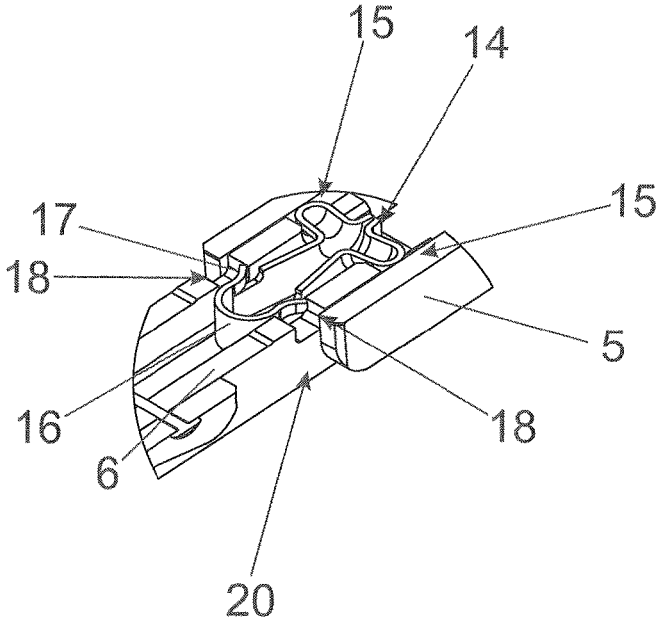
Figure 12E:
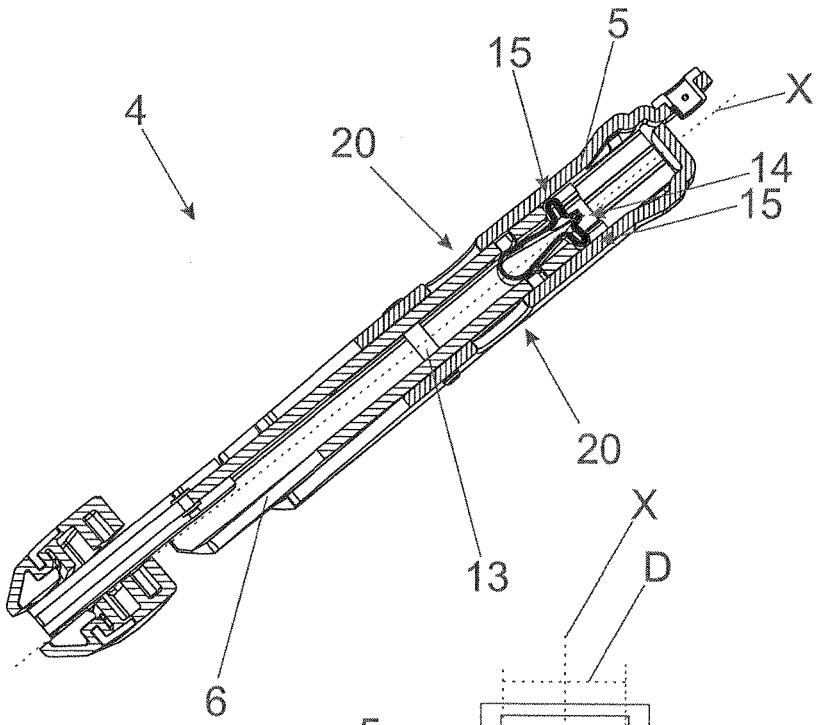
Figure 12F:
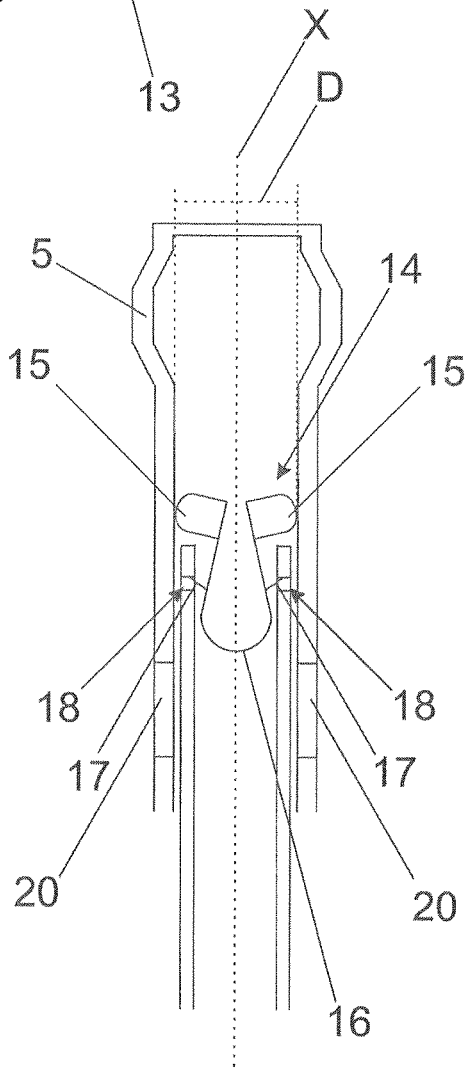
Figure 13A:
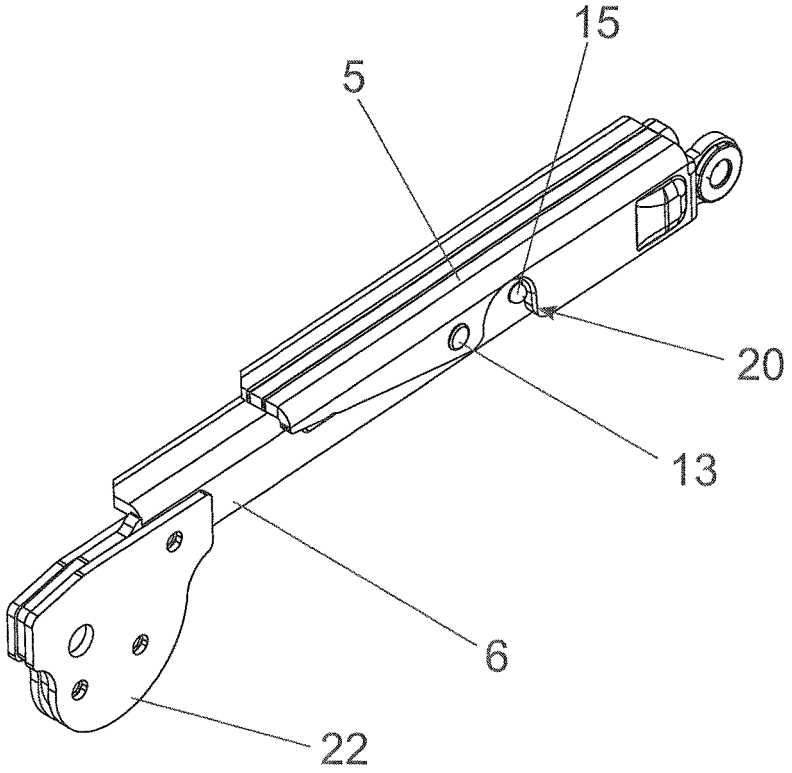
Figure 13B:
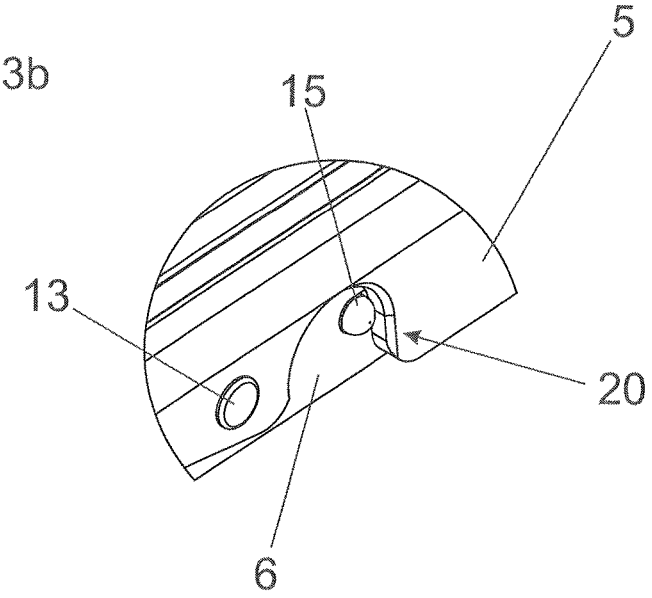
Figure 13C:
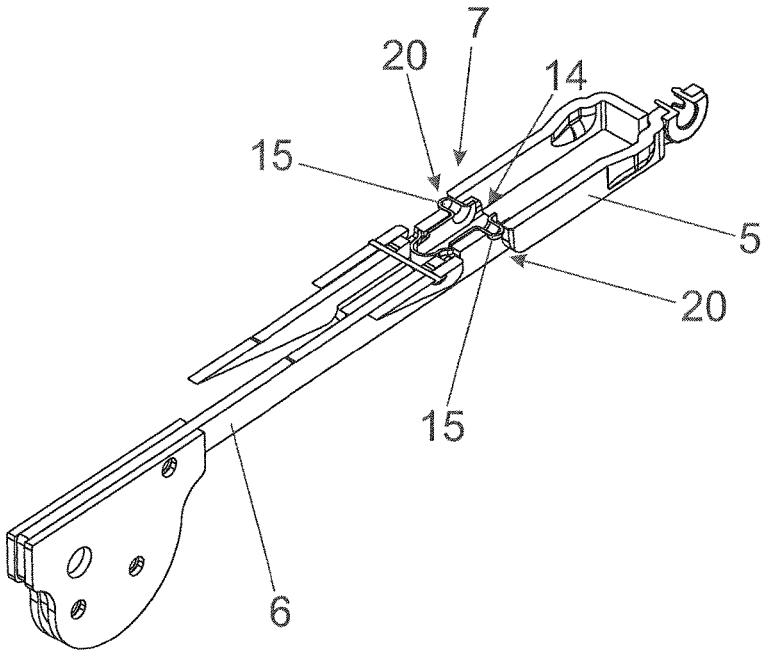
Figure 13D:
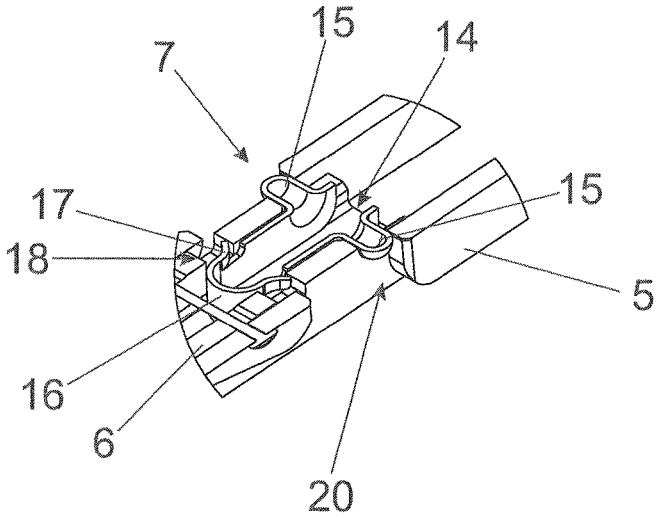
Figure 13E:
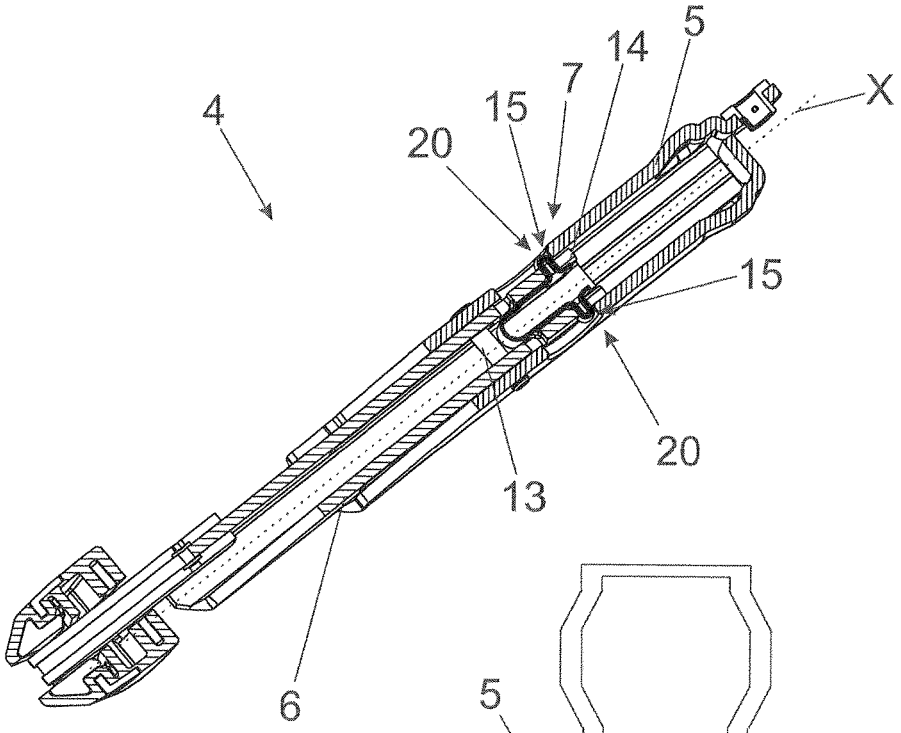
Figure 13F:
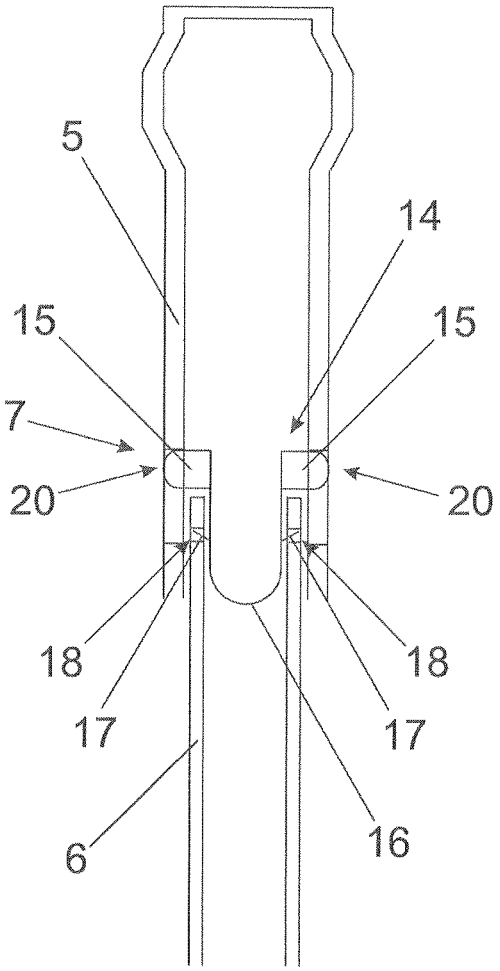

The mode of operation of the arresting device 8 will now be described with reference to FIGS. 11*a* through 11*f*. FIGS. 11*a* and 11*b* show a perspective view and a detailed perspective view of the actuating arm lever 4 which is in the mounting position. FIGS. 11*c* through 11*f* show various sectional views, whereby the spring element 14 can be seen in each case. In that respect FIG. 11*f* is purely diagrammatic to clearly show the functional principle. The spring element 14 has two protrusions 15 and a spring zone 16. The protrusions 15 define the transverse extent D of the spring element 14. In the arrested condition the spring zone 16, by virtue of its stress, presses the protrusions 15 against the recesses 19 whereby a releasable arresting action is produced.

The axis of movement X is that axis, along which the relative movements of the first lever 5 and the second lever 6 occur, which are permitted by the rail-like configuration of the two levers 5, 6.

By pulling on the second lever 6 a force is exerted on the spring element 14 by means of the projections 17 of the spring element 14 that engage into the openings 18. In the present embodiment that force is produced by the force storage means 9.

Inclined planes at the recesses 19 provide that, in the movement of the spring element 14, caused by the movement force, relative to the first lever 5, the protrusions 15 are compressed against the stress of the spring zone 16. As a result the transverse extent D of the spring element 14 is so reduced that the protrusions 15 can slide out of the recesses 19, thereby permitting a relative movement of the first lever 5 relative to the second lever 6 from the mounting position in the direction of the operating position. FIGS. 12*a* through 12*f* are similar to FIGS. 11*a* through 11*f*, wherein the actuating arm lever 4 is now in an intermediate position (see FIGS. 5*a* and 5*b*). The spring element 14 is so compressed that its transverse extent D is sufficiently small to find space in the non-widened part of the first lever 5.

FIGS. 13*a* through 13*f* show the actuating arm lever 4 similarly to FIGS. 12*a* through 12*f*, with the actuating arm lever 4 now being in the operating position. By virtue of the openings 20 in the first lever, the spring zone 16 of the spring element 14 is relieved of load whereby the spring element 14 assumes its full transverse extent D. The protrusions 15 now serve as locking bolts which in cooperation with the openings 20 lock the actuating arm lever 4 to prevent a reduction in length. A further increase in length of the actuating arm lever 4 is not possible by virtue of the above-described guide means 11.

FIGS. 14*a* and 14*b* show an article of furniture 10 with an actuating device 1 according to the invention. A situation is shown during the mounting method, with the actuating arm lever 4 not yet being connected to the furniture part 2.

The present invention is not limited to embodiments illustrated here. For example the spring element 14 would not have to be in the form of the embodiment illustrated here. Structures involving flat springs or spring tongues are also conceivable. The present invention is also not limited to actuating devices which have a pivotable housing 21. The configuration of the arresting device 8 by means of recesses 19 is not essential although that embodiment allows substantial relief of load on the spring element 14 in the mounting position.

The invention claimed is:

1. An actuating device for moveably mounting a furniture part to a furniture carcass comprising an actuating arm lever, wherein a first lever of the actuating arm lever is moveable relative to a second lever of the actuating arm lever from a mounting position for mounting the furniture part to the first lever of the actuating arm lever into an operating position with the furniture part mounted to the first lever, wherein the first lever is lockable relative to the second lever by means of an automatic locking device in the operating position.

2. The actuating device as set forth in claim 1, wherein a length of the actuating arm lever can be set by mobility of the first lever relative to the second lever.

3. The actuating device as set forth in claim 1, wherein the locking device is of a positively locking nature.

4. The actuating device as set forth in claim 1, wherein there is provided an arresting device for releasably arresting the first lever relative to the second lever in the mounting position of the actuating arm lever.

5. The actuating device as set forth in claim 4, wherein the arresting device includes precisely two recesses cooperating with the spring element, wherein the precisely two recesses further cooperate with the at least one protrusion.

6. The actuating device as set forth in claim 1, wherein there is provided a force storage means for acting on the actuating arm lever with a movement force for movement of the furniture part.

7. The actuating device as set forth in claim 6, wherein the arresting of the first lever relative to the second lever is releasable by action of the movement force.

8. The actuating device as set forth in claim 6, wherein the first lever is moveable relative to the second lever by the action of the movement force into the operating position.

9. The actuating device as set forth in claim 1, wherein there is provided a guide means for movements of the first lever relative to the second lever.

10. The actuating device as set forth in claim 1, wherein the locking device includes only one spring element.

11. The actuating device as set forth in claim 10, wherein a transverse extent of the spring element transversely with respect to a relative axis of movement of the first lever relative to the second lever can be reduced by an action against a spring force of the spring element.

12. The actuating device as set forth in claim 11, wherein the spring element is in a form of a shaped portion with at least one protrusion determining the transverse extent and a spring zone for producing the spring force.

13. The actuating device as set forth in claim 1, wherein the moveably mounted furniture part is in a form of a flap pivotable with respect to a horizontal axis.

14. An article of furniture comprising two actuating devices, as set forth in claim 1.

15. A method of mounting a moveable furniture part to a furniture carcass by means of at least one actuating device as set forth in claim 1, wherein the furniture part is moveable between an opened position and a closed position, wherein by the following steps:

a) fixing the at least one actuating device to the furniture carcass, wherein the first lever is disposed in the mounting position relative to the second lever of the at least one actuating device, b) fixing the moveable furniture part to the first lever, and c) moving the first lever relative to the second lever into the operating position by moving the moveable furniture part towards the closed position or the opened position.

16. The actuating device as set forth in claim 1, wherein there is provided an arresting device for releasably arresting the first lever relative to the second lever in the mounting position of the actuating arm lever; where the arresting device includes only one spring element.

17. An actuating device for moveably mounting a furniture part to a furniture carcass comprising an actuating arm lever, wherein a first lever of the actuating arm lever is moveable relative to a second lever of the actuating arm lever from a mounting position into an operating position, wherein the first lever is lockable relative to the second lever by means of an automatic locking device in the operating position, wherein there is provided a guide means for movements of the first lever relative to the second lever, and wherein the guide means has a slot and a guide pin cooperating with the slot, wherein the slot is arranged on one of the first lever and the second lever and the guide pin is fixed to the other of the first lever and the second lever.

18. An actuating device for moveably mounting a furniture part to a furniture carcass comprising an actuating arm lever, wherein a first lever of the actuating arm lever is moveable relative to a second lever of the actuating arm lever from a mounting position into an operating position, wherein the first lever is lockable relative to the second lever by means of an automatic locking device in the operating position, wherein the locking device includes only one spring element, and wherein the spring element includes at least one projection which by cooperation with an opening on the first lever or on the second lever limits relative movements of the spring element relative to the first lever or to the second lever.

19. An actuating device for moveably mounting a furniture part to a furniture carcass comprising an actuating arm lever, wherein a first lever of the actuating arm lever is moveable relative to a second lever of the actuating arm lever from a mounting position into an operating position, wherein the first lever is lockable relative to the second lever by means of an automatic locking device in the operating position, wherein the locking device includes only one spring element, and wherein the locking device includes precisely two openings cooperating with the spring element, wherein the precisely two openings preferably cooperate with the at least one protrusion.

* * * * *